US009257776B2

(12) United States Patent
Kramer

(10) Patent No.: US 9,257,776 B2
(45) Date of Patent: Feb. 9, 2016

(54) REDUCED PROFILE POP-UP ELECTRICAL RECEPTACLE ASSEMBLY

(71) Applicant: Kramer Electronics Ltd., Jerusalem (IL)

(72) Inventor: Joseph Kramer, Mevasseret Zion (IL)

(73) Assignee: KRAMER ELECTRONICS LTD., Jerusalem (IL)

( * ) Notice: Subject to any disclaimer, the term of this patent is extended or adjusted under 35 U.S.C. 154(b) by 0 days.

(21) Appl. No.: 14/374,983

(22) PCT Filed: Jan. 20, 2013

(86) PCT No.: PCT/IL2013/000006
§ 371 (c)(1),
(2) Date: Jul. 28, 2014

(87) PCT Pub. No.: WO2013/111125
PCT Pub. Date: Aug. 1, 2013

(65) Prior Publication Data

US 2015/0008805 A1 Jan. 8, 2015

(30) Foreign Application Priority Data

Jan. 29, 2012 (IL) ..... 217810

(51) Int. Cl.
*H01R 13/447* (2006.01)
*A47B 97/00* (2006.01)
(Continued)

(52) U.S. Cl.
CPC ..... *H01R 13/447* (2013.01); *A47B 21/06* (2013.01); *A47B 97/00* (2013.01); *H01R 13/46* (2013.01); *A47B 2021/066* (2013.01); *A47B 2200/0082* (2013.01)

(58) Field of Classification Search
CPC ..... H01R 13/447; H01R 13/44; H02G 3/185; A47B 2021/066; A47B 2021/068; A47B 21/0073; A47B 21/06; A47B 2200/0082; A47B 2200/068; A47B 2200/0081; A47B 2200/0083
See application file for complete search history.

(56) References Cited

U.S. PATENT DOCUMENTS 3,992,070 A 11/1976 Dunn et al.
5,230,552 A * 7/1993 Schipper et al. ..... 312/223.6
(Continued)

FOREIGN PATENT DOCUMENTS

DE 202006009401 U1 8/2006
DE 202008003377 U1 5/2008

OTHER PUBLICATIONS

International Search Report and Written Opinion of the International Searching Authority,10 pages, Nov. 7, 2013.

*Primary Examiner* — Daniel Rohrhoff
(74) *Attorney, Agent, or Firm* — Moser Taboada

(57) ABSTRACT

A pop-up enclosure system (30) for electronic equipment, includes a receptacle (31) adapted for mounting in a work-surface (15) and containing one or more electrical outlets (32) for connection of equipment thereto, and a bezel (33) supported by the receptacle and adapted for countersinking in said work-surface. A top plate (34) is dimensioned for closing an opening defined by the bezel, and a hinge (35) is mounted at an edge of the top plate and the bezel for hingedly attaching the top plate to the bezel so as to allow rotation of the top plate from a closed position to a fully open position wherein the edge of the top plate abuts an upper surface of the bezel. A releasable resilient opening force (37) is fixed to the receptacle and articulated to the top plate for opening the top plate.

11 Claims, 5 Drawing Sheets

(51) Int. Cl.
*A47B 21/06* (2006.01)
*H01R 13/46* (2006.01)

(56) References Cited

U.S. PATENT DOCUMENTS

| | | | | |
|---|---|---|---|---|
| 6,028,267 | A * | 2/2000 | Byrne | 174/59 |
| 6,162,071 | A * | 12/2000 | Muller | 439/142 |
| 6,338,301 | B1 * | 1/2002 | Almond | 108/50.02 |
| 6,416,336 | B1 | 7/2002 | Schulte et al. | |
| 6,802,577 | B2 | 10/2004 | Gershfeld | |
| 7,045,706 | B1 * | 5/2006 | Lincoln et al. | 174/482 |
| D553,306 | S | 10/2007 | Hansen | |
| 2003/0070592 | A1 * | 4/2003 | Grasse et al. | 108/50.02 |
| 2004/0075373 | A1 * | 4/2004 | Gershfeld | 312/223.3 |
| 2004/0147147 | A1 | 7/2004 | Griepentrog | |
| 2005/0126809 | A1 * | 6/2005 | Drane et al. | 174/48 |
| 2005/0268823 | A1 * | 12/2005 | Bakker et al. | 108/50.02 |
| 2006/0283631 | A1 * | 12/2006 | Drane | 174/480 |
| 2007/0022918 | A1 * | 2/2007 | Sweet et al. | 108/50.02 |
| 2008/0135285 | A1 * | 6/2008 | Drane et al. | 174/483 |
| 2010/0072198 | A1 * | 3/2010 | Roemer | H02G 3/185 220/3.3 |
| 2010/0206603 | A1 * | 8/2010 | Drane | 174/66 |
| 2011/0061886 | A1 * | 3/2011 | Gow | 174/67 |
| 2013/0078853 | A1 * | 3/2013 | Dinh | 439/535 |
| 2015/0009652 | A1 * | 1/2015 | Alexander et al. | 362/95 |

* cited by examiner

REDUCED PROFILE POP-UP ELECTRICAL RECEPTACLE ASSEMBLY

FIELD OF THE INVENTION

This invention relates to a pop-up enclosure system for electronic equipment, such as audio/visual and power connectors, concealable in a table top.

BACKGROUND OF THE INVENTION

Pop-up enclosures are known having a body portion that is recessed into a table top and a top plate that is substantially flush with the table and lifts off to provide access to connectors that are concealed when the top plate is closed. Such pop-up enclosures are described, for example, in U.S. Pat. No. 6,802,577, which describes an enclosure system having a saddle that is attached to a bezel and defines an open area for receiving an enclosure. The bezel defines an opening for receiving a top plate of the enclosure. An outer perimeter of the bottom surface of the bezel rests on edges of an opening cut through a table top. The enclosure pivots from a concealed position, in which the top plate is flush with the bezel, to an open position in which the face plate of the enclosure is exposed. A spring biases the enclosure towards the open position, while a latch maintains the enclosure in the concealed position.

As shown in FIG. 1 of U.S. Pat. No. 6,802,577, the top plate swings about a hinge axis close to a rear edge of the top plate. In the device disclosed by U.S. Pat. No. 6,802,577, the spring bias is constituted by a gas spring comprising a body into which a piston may be extended and retracted. In the normal state, the gas spring is extended and exerts force on the piston, which is thus applied to a lower inside surface of the top plate so as to urge it open. The top plate is closed against the force of the retracted gas spring and is latched by a catch so as to restrain the top plate in the closed position where it is flush with the top surface of the enclosure system. A similar arrangement is shown in U.S. Pat. No. 3,992,070.

Since the force exerted by the gas spring is predetermined by the type of device used and is generally a function of size, some tradeoff is usually called for between the desire for compactness of the pop-up enclosure, on the one hand, and the requirement that the top plate operate effectively, on the other. These two desiderata are, to some extent, mutually exclusive as will now be explained with reference to FIGS. 1 to 3 showing schematically in cross-section a detail of a prior art pop-up enclosure 10. The enclosure 10 includes a top plate 11 that has a rear edge 12 and is hingedly attached by a hinge axis 13 to a receptacle 14 that is flush mounted with a work surface 15. A gas spring 16 is pivotally anchored at one end 17 to an inside of the receptacle 14, its opposite end being pivotally attached to a support 18 mounted on the inner surface of the top plate 11 so as to be rotatable about a pivot axis 19.

Electronic equipment such as video, audio and power sockets represented by the box 20 in FIGS. 2 and 3 are mounted inside the receptacle 14 so as to be concealed by the top plate 11 when closed while being accessible when open. The equipment 20 occupies most of the central region of the receptacle, which limits the point on the lower surface of the top plate to where the gas spring 16 may be fixed. Specifically, the location of the pivot axis 19 determines the point of application of force by the gas spring 16, such that the greater the distance between the hinge axis 13 the pivot axis 19, the greater is the applied moment (for a given gas spring force) and vice versa. However, since most of the space within the receptacle is occupied, the gas spring 16 needs to be mounted behind the equipment. This generally requires that it be anchored via a bracket 21 that is fixed to an inner surface of the receptacle or an outer surface of the equipment 20. As the top plate opens, the gas spring extends and turns about its point of attachment to the bracket 21. Regardless of whether the bracket 21 is anchored to the receptacle or the equipment, it is clear that as the support 18 moves further away from the hinge axis 13, the lower point of attachment of the gas spring 16 must move further away from the equipment 20. This is well demonstrated in FIG. 3, which compares the two arrangements in FIGS. 1 and 2, the arrangement in FIG. 2 being illustrated by the dashed line.

It thus emerges that while mounting the support 18 farther away from the hinge axis 13 increases the moment of the gas spring 16 and facilitates opening of the top plate, it militates against compactness of the pop-up assembly.

Consequently, compactness is increased by bringing the pivot axis 19 closer to the hinge axis 13.

US D553,306 in the name of FSR, Inc. discloses a tabletop mounted connection box having a circular lid that turns about a hinge axis located toward a rear of the lid. Owing to its circular profile, the device is easily installed by drilling a hole in a work surface using a drill-mounted hole-saw, which is well within the capability of the average homeowner. The device is sold under the catalog names T3-AC2/T3-PC1/T3-PC1D and offers a low footprint and easy installation. However, it is designed for manual operation by pressing down on a tip of the lid near the hinge as shown to schematically in FIG. 4. This requires that the hinge axis 13 be displaced from the ridge of the lid in order to be able to apply an adequate moment.

It would be an advantage to use a gas spring or similar resilient bias force to lift the lid automatically. Theoretically, this might be done by anchoring a spring to a support pivot mounted near the ridge underneath the lid so as to apply a tensile force that turns the lid about the hinge axis. In practice, it does not appear to be feasible to do this to the device shown in US D553,306 for a number of reasons. First, the lid is connected to a concealed hinge via a bracket that is fixed to the lower surface of the lid with the result that the lid is vertical when fully opened. A spring would need to be affixed to the edge of the lid to pull it open to a vertical orientation and this is both neither esthetic nor practical. On the other hand, a spring mounted on the lower surface of the lid near the ridge will result in the lid being incompletely opened, thus restricting access to the equipment therein.

A gas spring is preferable to a coil spring because it opens slowly and in a controlled manner unlike a coil spring, which opens almost instantaneously upon release, resulting in too aggressive an action. However, the difficulties are compounded when attempting to automate opening of the lid using a gas spring without derogating from the compactness of the unit, as explained above.

SUMMARY OF THE INVENTION

It is an object of the invention to provide a compact pop-up enclosure system for electronic equipment that is automatically opened and that addresses the above issues.

To this end there is provided in accordance with the invention a pop-up enclosure system for electronic equipment, the pop-up enclosure system comprising:

a receptacle adapted for mounting in a work-surface and containing one or more electrical outlets for connection of equipment thereto, a bezel supported by the receptacle and adapted for countersinking in said work-surface, a top plate dimensioned for closing an opening defined by said bezel, a hinge mounted at an edge of the top plate and the bezel for hingedly attaching the top plate to the bezel so as to allow rotation of the top plate from a closed position to a fully open position wherein the edge of the top plate abuts an upper surface of the bezel; and a releasable resilient opening force fixed to the receptacle and articulated to the top plate for opening the top plate.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
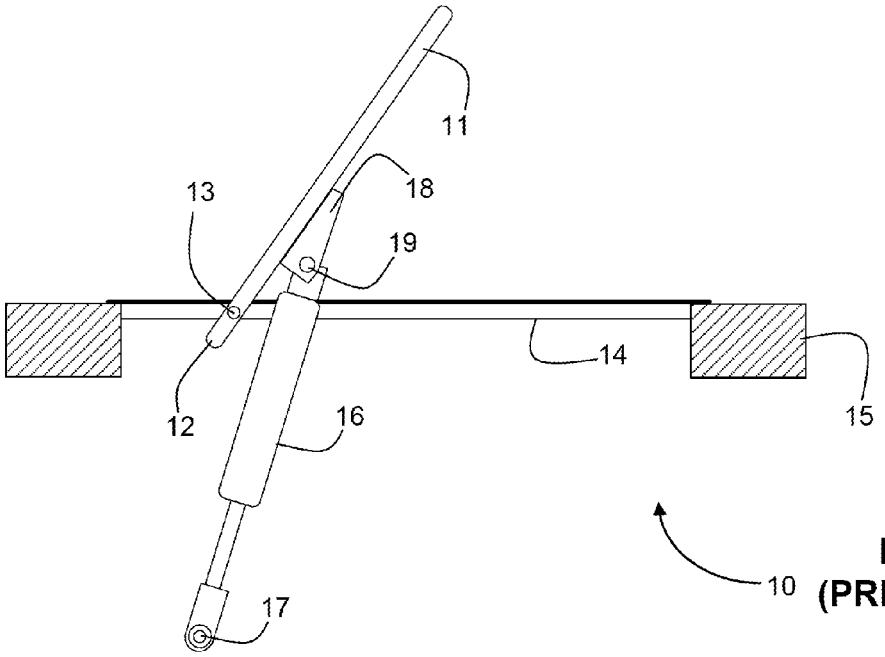
FIG. 1 (PRIOR ART)
FIGS. 1 to 4 are schematic views showing details of prior art pop-up enclosures.

In the following description of some embodiments, identical components that appear in more than one figure or that share similar functionality will be referenced by identical reference symbols.

Referring to FIGS. 5 to 11 there is shown a pop-up enclosure system 30 for electronic equipment comprising a receptacle 31 adapted for mounting in a work-surface (shown as 15 in FIGS. 1 to 3) and containing one or more electrical outlets 32 for connection of equipment thereto. A bezel 33, which is supported by the receptacle 31 and is adapted for countersinking in the work-surface 15, defines an opening for receiving a circular top plate 34. The top plate 34 is hingedly mounted to the bezel 33 by means of a hinge 35 mounted on a lower surface of the top plate 34 near a rim 36 thereof and is biased in an open position by a pneumatic piston 37 also known as gas spring (constituting a resilient opening force). A catch 38 is mounted in association with the receptacle 31 for restraining the top plate 34 in a closed position against the resilient opening force of the pneumatic piston 37. The catch 38 may be a push-to-engage, push-to-release device that is mounted on an upper surface 39 of the receptacle and engages a protuberance 40 projecting from a lower surface of the top plate 34 toward the front of the rim 36 opposite the hinge 35.

Figure 2:
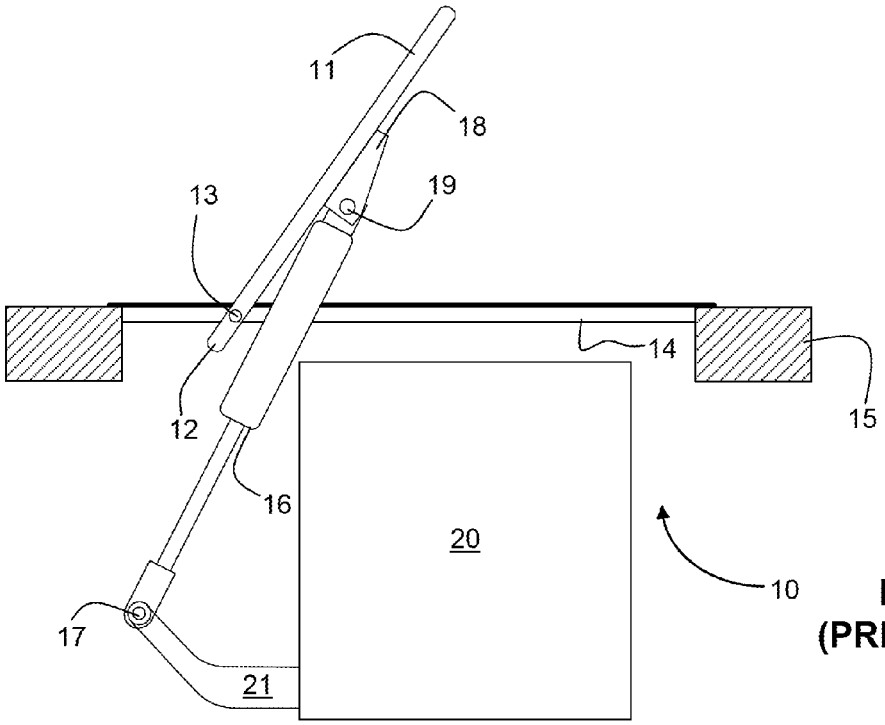
FIG. 2 (PRIOR ART)
Figure 3:
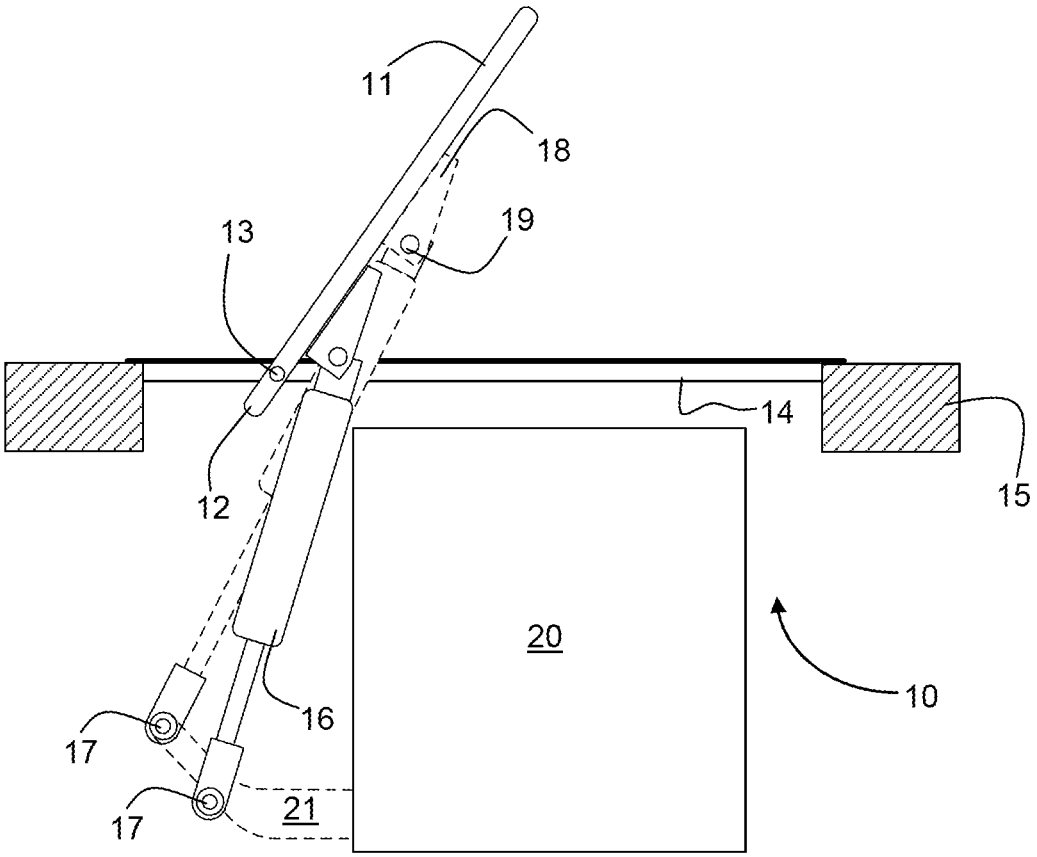
FIG. 3 (PRIOR ART)
Figure 4:
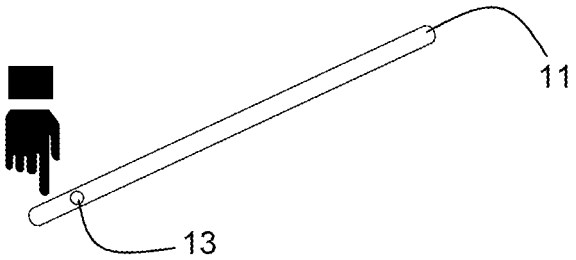
FIG. 4 (PRIOR ART)
Figure 5:
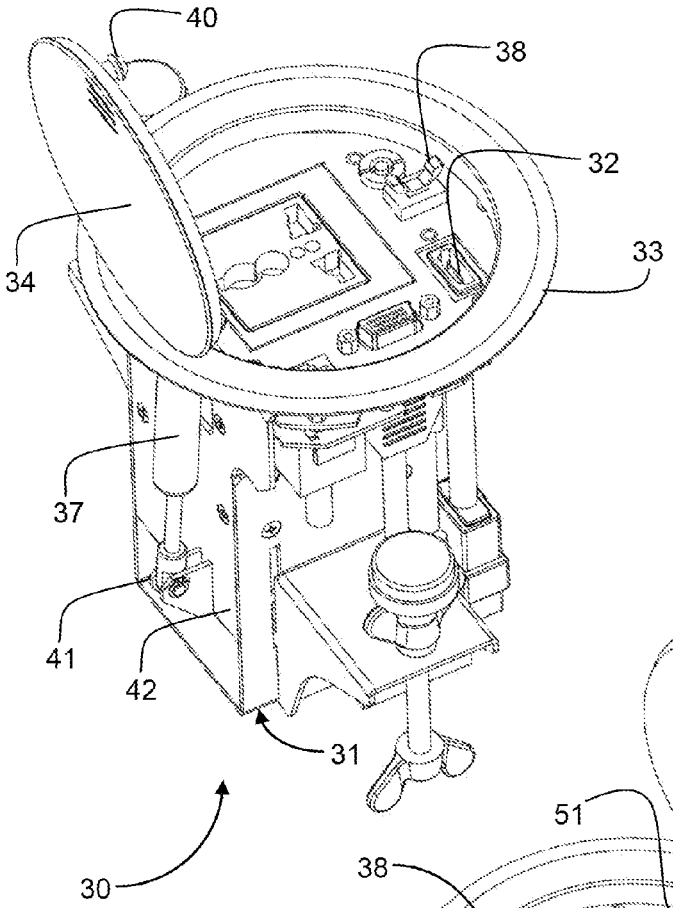
FIGS. 5 to 8 are perspective views showing details of a pop-up enclosure system according to an embodiment of the invention.
Figure 6:
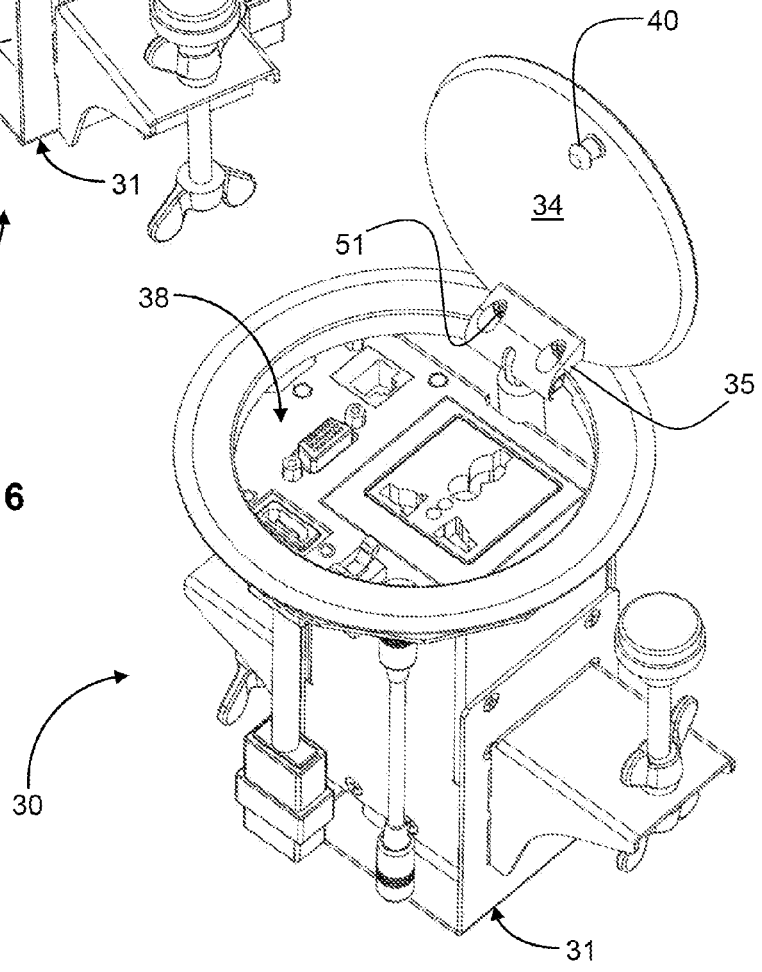
Figure 7:
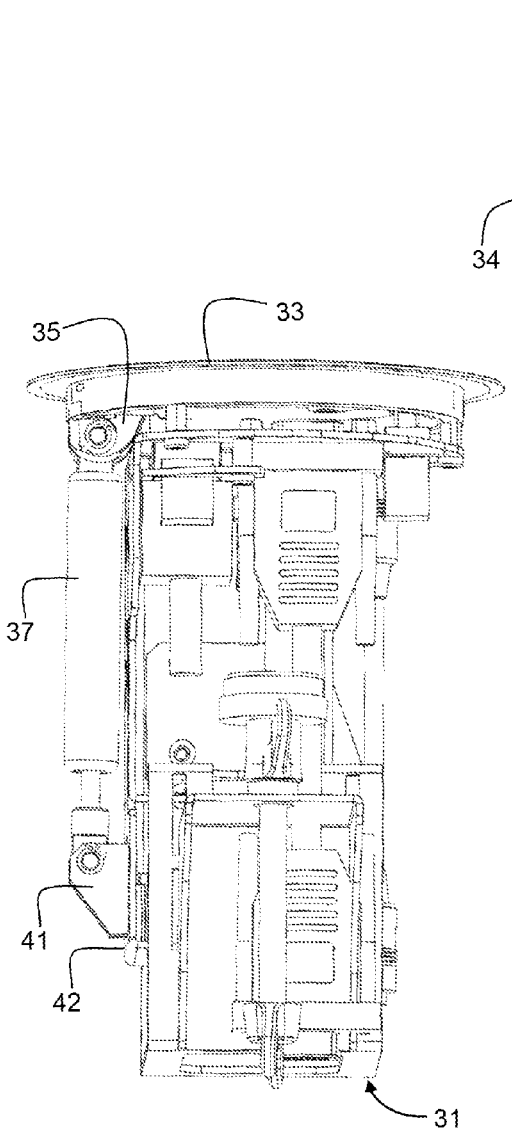
Figure 8:
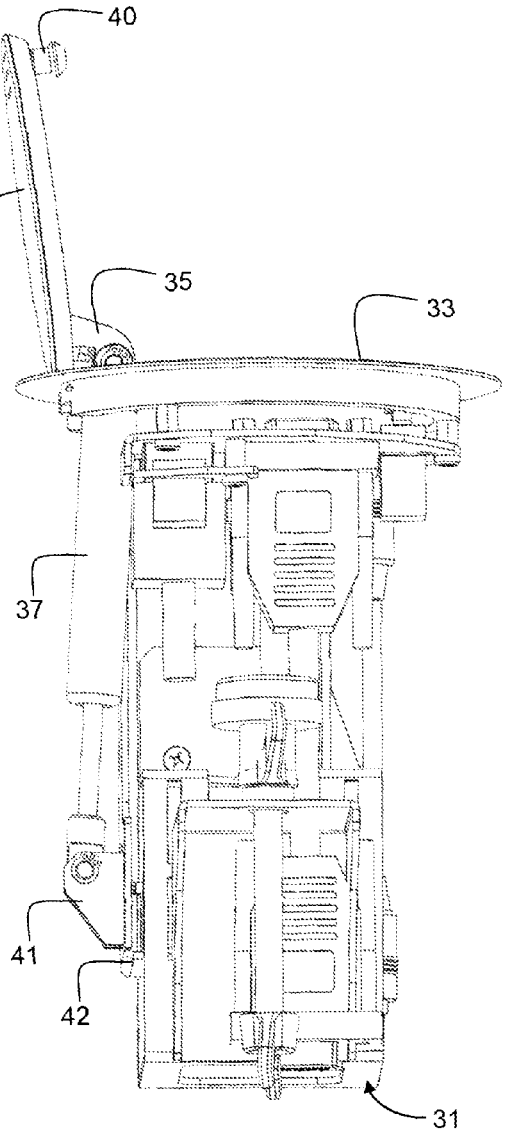

FIGS. 7 and 8 show side elevations of the pop-up enclosure system 30 in the closed and open positions, respectively, the pneumatic piston 37 being articulated at one end to the top plate 34 and being articulated at its opposite end to a bracket 41 fixed to a rear outer wall 42 of the receptacle 31. As seen in FIG. 6, the bezel 33 is dimensioned so as to provide sufficient clearance between the point of attachment of the pneumatic piston 37 to the top plate 33 and the rear outer wall 42 of the receptacle 31. This, of course, is also true in known designs such as shown in FIGS. 1 to 3. However, the invention is distinguished over known pop-up enclosure system in the manner in which the pneumatic piston 37 is articulated to the top plate 33 so as to minimize the required clearance and reduce the footprint of the system.

Thus, with particular reference to FIGS. 7 and 8 it is seen that in both the closed and open positions, the pneumatic piston 37 is very nearly vertical. It is apparent that closing the top plate 34 induces rotation of the hinge 35 and pushes the upper end of the pneumatic piston 37 slightly outward to the position shown in FIG. 7. Nevertheless, in both the closed and open positions, the point of attachment of the pneumatic piston 37 to the hinge 35 is closer to the rear outer wall 42 of the receptacle 31 than is its point of attachment to the bracket 41. Consequently, it is the slightly larger overhang of the bracket 41 that determines the footprint of the pop-up enclosure system 10, which is reduced significantly by articulating the resilient opening force that is pivotally coupled to the hinge.

Figure 9:
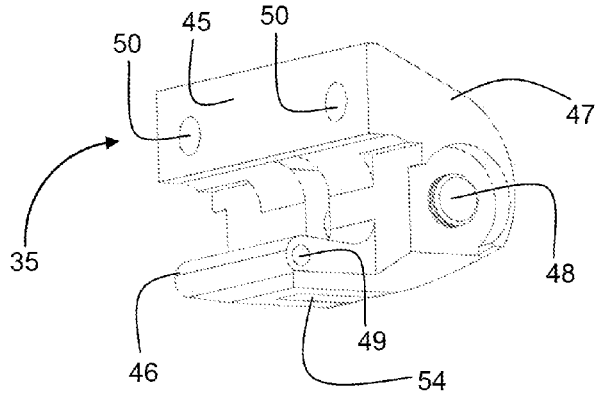
FIG. 9 is a perspective detailed view of a hinge used in the pop-up enclosure shown in FIGS. 5 to 8.
Figure 10:
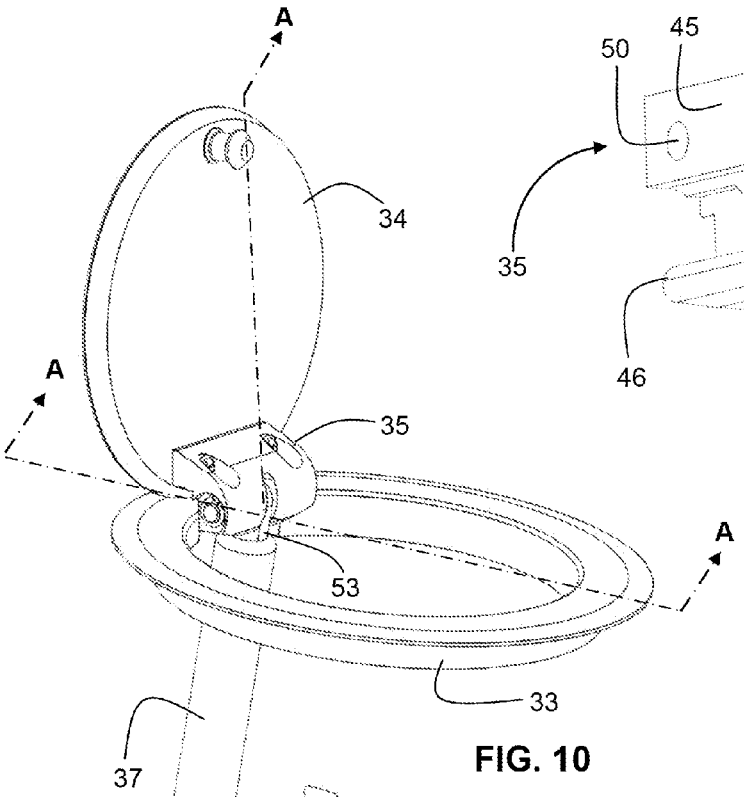
FIG. 10 is a perspective view showing connection of the hinge to a top plate of the pop-up enclosure.
Figure 11:
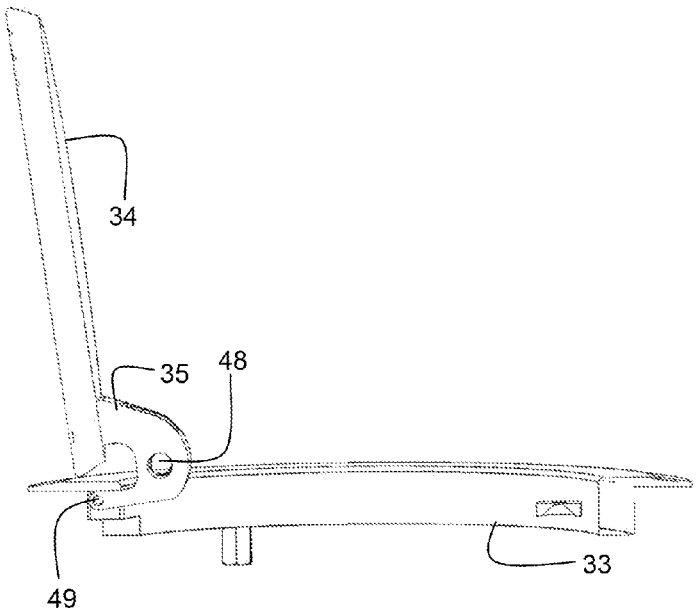
FIG. 11 is a partial cross-sectional elevation through a plane defined by arrows A-A in FIG. 10 showing further details of the hinge.

FIGS. 9 to 11 show further details of the hinge 35 which is generally U-shaped in cross-section and comprises an upper finger 45 and lower finger 46 projecting from a tubular body portion 47 having a first bore 48 and a second bore 49 is formed through a tip of the lower finger 46. Apertures 50 are formed in the upper finger 45 for fixing the hinge 35 to the top plate 34 by screws 51 as shown in FIG. 6. The first bore 48 constitutes a first hinge axis to which an upper end of the pneumatic piston 37 is pivotally attached by a shaft 52. The second bore 49 constitutes a second hinge axis that is parallel to the first hinge axis and which is pivotally attached to the bezel 33.

The upper end of the pneumatic piston 37 has an eyelet 53 that is freely accommodated within a slot 54 in the lower finger 46 so as to be pivotally connected to the hinge 35 by the shaft 52. When the pneumatic piston 37 extends, it pushes against the lower surface of the lower finger 46 thereby inducing rotation of the hinge 35 about the second hinge axis, thereby opening the top plate 34 until the edge of the top plate 34 abuts an upper surface of the bezel 33 as shown in FIG. 11. The top plate 34 is closed by manually pushing down on the top plate against the resilient bias of the pneumatic piston 37 until the protuberance 40 engages the catch 38. The unique design of the hinge 35 permits the top plate 34 to be closed without leaving an unseemly gap between its periphery and an inner edge of the bezel 33, the mating surfaces of which may be beveled to ensure a tight fit.

It should be noted that while the general principles of the invention as described are applicable to pop-up enclosures of any shape, the invention is of particular benefit for round pop-up enclosures since the requirement to exert the opening force at the periphery of the top plate poses a particular problem that is neatly solved by the construction according to the invention.

While in the embodiment described, the resilient opening force is a pneumatic piston it, any other suitable biasing force may be used in order to ensure that upon releasing the catch, the top plate 34 swings open automatically. For example, the resilient opening force may be a hydraulic piston or a spring. In the embodiment described, the piston 37 is normally in the extended state and is retracted into a body of the pneumatic piston 37 upon closing the top plate 34.

It will also be understood that while in the embodiment as described, the top plate is restrained in the closed position by a catch mounted in association with the receptacle, alternatively the resilient opening force may be self-locking. For example, an integral lockable gas spring may be used such as is available from Bansbach® easylift GmbH of Lorch, Germany and described in their website.

The invention claimed is:

1. A pop-up enclosure system for electronic equipment, the pop-up enclosure system comprising:

a receptacle adapted for mounting in a work-surface and containing one or more electrical outlets for connection of equipment thereto, a circular bezel supported by the receptacle and adapted for countersinking in said work-surface, a circular top plate dimensioned for closing an opening defined by said bezel, a hinge mounted at a circular edge along a portion of a circumference of the top plate and the bezel for hingedly attaching the top plate to the bezel so as to allow rotation of the top plate from a closed position to an open position wherein the circular edge of the top plate abuts an upper surface of the bezel; and a releasable resilient opening force fixed to the receptacle and articulated to the top plate for opening the top plate.

2. The pop-up enclosure system according to claim 1, wherein mating surfaces of the bezel and the top plate are beveled.

3. The pop-up enclosure system according to claim 1, wherein the resilient opening force is pivotally coupled to the hinge.

4. The pop-up enclosure system according to claim 1, wherein the hinge has a first hinge axis for pivotally attaching to the resilient opening force and a second hinge axis for pivotally attaching to the bezel.

5. The pop-up enclosure system according to claim 4, wherein:

the hinge is U-shaped in cross-section and comprises upper and lower fingers projecting from a body portion, the first hinge axis is located in the body of the hinge, the second hinge axis is located at a tip of the lower finger, and the upper finger is adapted for fixing the hinge to the top plate.

6. The pop-up enclosure system according to claim 1, wherein the resilient opening force is a pneumatic or hydraulic piston.

7. The pop-up enclosure system according to claim 1, further including a catch mounted in association with the receptacle for restraining the top plate in a closed position against said resilient opening force.

8. The pop-up enclosure system according to claim 7, wherein the catch is a push-to-engage, push-to-release device that is mounted at an inner edge of the receptacle and engages a protuberance projecting from a lower surface of the top plate.

9. The pop-up enclosure system according to claim 1, wherein the resilient opening force is self-locking.

10. The pop-up enclosure system according to claim 9, wherein the resilient opening force is an integral lockable gas spring.

11. A pop-up enclosure system for electronic equipment, the pop-up enclosure system comprising:

a receptacle adapted for mounting in a work-surface and containing one or more electrical outlets for connection of equipment thereto, a circular bezel supported by the receptacle and adapted for countersinking in said work-surface, a circular top plate dimensioned for closing an opening defined by said bezel, a hinge mounted at an edge of the top plate and the bezel for hingedly attaching the top plate to the bezel so as to allow rotation of the top plate from a closed position to an open position wherein the edge of the top plate abuts an upper surface of the bezel; and a releasable resilient opening force fixed to the receptacle and articulated to the top plate for opening the top plate, wherein:

the hinge has a first hinge axis for pivotally attaching to the resilient opening force and a second hinge axis for pivotally attaching to the bezel, the hinge is U-shaped in cross-section and comprises upper and lower fingers projecting from a body portion, the first hinge axis is located in the body of the hinge, the second hinge axis is located at a tip of the lower finger, and the upper finger is adapted for fixing the hinge to the top plate.

* * * * *